US005365841A

United States Patent [19]

Uhrig

[11] Patent Number: 5,365,841

[45] Date of Patent: Nov. 22, 1994

[54] SAFETY DEVICE FOR CONTROL OR REGULATION SYSTEMS OF DRIVE UNITS OF A PRINTING MACHINE

[75] Inventor: Dieter Uhrig, Eberbach, Germany

[73] Assignee: Heidelberger Druckmaschinen AG, Heidelberg, Germany

[21] Appl. No.: 11,965

[22] Filed: Feb. 1, 1993

[30] Foreign Application Priority Data

Jan. 31, 1992 [DE] Germany ..... 4202722

[51] Int. Cl.[5] ..... B41F 5/00

[52] U.S. Cl. ..... 101/212; 101/136; 101/152; 101/181; 101/183; 101/DIG. 41; 464/160

[58] Field of Search ..... 101/181, 183, 212, 216, 101/219, DIG. 41, 136, 141, 152, 153, 173, 174, 180; 464/30, 160, 161, 185; 318/45, 49, 85, 112, 113

[56] References Cited

U.S. PATENT DOCUMENTS

| | | | |
|---|---|---|---|
| 3,358,595 | 12/1967 | Lindemann | 101/183 |
| 3,452,261 | 6/1969 | Tagliasacchi | 101/181 X |
| 3,998,156 | 12/1976 | Zimmer | 101/248 X |
| 4,240,346 | 12/1980 | Landis et al. | 101/139 |
| 4,899,655 | 2/1990 | Seo et al. | 101/181 |
| 4,915,531 | 4/1990 | Mangiavacchi | 403/337 |
| 4,951,567 | 8/1990 | Bodi et al. | 101/216 |

FOREIGN PATENT DOCUMENTS

| | | | |
|---|---|---|---|
| 572806 | 3/1933 | Germany | 101/220 |
| 3638442 | 10/1987 | Germany | 101/183 |
| 3614979 | 11/1987 | Germany . | |
| 7808954 | 3/1980 | Netherlands | 101/181 |
| 2149149 | 6/1985 | United Kingdom . | |

OTHER PUBLICATIONS

German Journal; Maschinenbautechnik 29, 1980, 2, pp. 62–63.

German Journal: Der Elektronik 4, 1983, pp. 46–48.

*Primary Examiner*—Edgar S. Burr

*Assistant Examiner*—Christopher A. Bennett

*Attorney, Agent, or Firm*—Herbert L. Lerner; Laurence A. Greenberg

[57] ABSTRACT

Safety device for control or regulation systems of drive units of a printing machine having at least individual sub-aggregates thereof mechanically disconnected from one another, a plurality of motors connected via respective gear transmissions to the sub-aggregates for driving them in synchronous rotation, at least one measuring device for ensuring synchronous running of the sub-aggregates, and a device for controlling the rotary speed or the torque of the motors connected to the measuring device, further includes a clutch disposed between the gear transmissions of two of the at least individual sub-aggregates located adjacent one another, the clutch having clutch halves respectively connected to a synchronously running gearwheel of the respective gear transmissions, the clutch halves being connected to one another for transmitting torque when a preset rotational-angle difference between the clutch halves is exceeded.

5 Claims, 3 Drawing Sheets

SAFETY DEVICE FOR CONTROL OR REGULATION SYSTEMS OF DRIVE UNITS OF A PRINTING MACHINE

The invention relates to a safety device for control or regulation systems of drive units of a printing machine and, in particular, so as to avoid mechanical collisions occurring between a cylinder and a gripper device in a transfer area of two mechanically decoupled or disconnected printing units. The invention may be used on a printing machine having sub-aggregates which have been mechanically disconnected from one another individually or in groups and which, via gear drives, are driven by a plurality of motors so in synchronism.

It has become known, heretofore, for example, from the German-language journal, Maschinenbautechnik 29, 1980, 2, pages 62–63 thereof, as well as from published British Patent Application 2 149 149 A, to provide sub-aggregates or groups of sub-aggregates of a printing machine with a respective separate drive, each of the drives having a control device for the rotary speed or mechanical performance of the respective drive assignable thereto.

Depending upon the respective application, the control devices may have different constructions and different dimensions with respect to trouble or breakdown behavior .and guidance or control behavior. (note the German-language journal, Der Elektroniker 4, 1983, pages 46–48). It is accordingly possible to assign precisely to all separately driven sub-aggregates one control loop for rotary speed which includes a respective incremental rotary encoder for the actual rotary speed, all of the control loops being operatable with a common reference rotary speed in the form of a reference input.

Because the angular synchronism of the sub-aggregates, in the case of such drive concepts, is not achieved by mechanical constraint, e.g., by means of closed gear trains or with the aid of so-called longitudinal shafts, a disadvantage results in that the sub-aggregates tend to run out of synchronism if one of the controllers fails or malfunctions so that there is the risk of a mechanical collision between mechanical components of two neighboring sub-aggregates. An example thereof may be the possible collision between a cylinder and a gripper device in the transfer area of two mechanically disconnected or decoupled printing units of a sheet-fed printing machine.

Conventional safety devices actuate a safety cut-out if the controllers indicate a control deviation exceeding a given threshold value, the safety cut-out either purely electronically effecting an emergency stop of the drive motors or actuating a safety clutch provided in the gear train so that the flow of power in the gear train is interrupted, a mechanical emergency brake being thereby additionally able to be engaged (U.S. Pat. No. 4,951,567).

Because of the varying moments of inertia of the masses displaced within the sub-aggregates, the angular synchronism must be maintained reliably even during braking in event of a breakdown or of an emergency situation, an accomplishment which is achievable by the use of quickly acting controllers. Apart from the fact that a synchronous braking or deceleration of a printing machine may not be achieved in a limited collision-free rotational-angle range because the controller only has a finite adjusting speed, a risk arises, furthermore, of a possible controller failure and a consequent risk of damage or destruction of machine parts due to collisions.

It is accordingly an object of the invention to provide a safety device for control or regulation systems of decoupled or disconnected drive units at a printing machine, the safety device being capable of preventing all collisions between mechanical components if a respective control system or regulation system should fail or malfunction.

With the foregoing and other objects in view, there is provided, in accordance with the invention, safety device for control or regulation systems of drive units of a printing machine having at least individual sub-aggregates thereof mechanically disconnected from one another, a plurality of motors connected via respective gear transmissions to the sub-aggregates for driving them in synchronous rotation, at least one measuring device for ensuring synchronous running of the sub-aggregates, and a device for controlling the rotary speed or the torque of the motors connected to the measuring device, comprising a clutch disposed between the gear transmissions of two of the at least individual sub-aggregates located adjacent one another, the clutch having clutch halves respectively connected to a synchronously running gearwheel of the respective gear transmissions, the clutch halves being connected to one another for transmitting torque when a preset rotational-angle difference between the clutch halves is exceeded.

During standard or normal operation, the gear transmissions are driven synchronously by the control or regulating system. The control deviation causes a rotational-angle difference between the gearwheels and the clutch halves, respectively, the rotational-angle difference being permissible for the standard or normal operation and being, for example, within the range of circumferential-register adjustment. The clutch does not transmit a torque and the clutch halves run idle within the range of this permissible rotational-angle difference. Only when a controller failure occurs or any interferences which cannot be eliminated are produced in the drive units, are the clutch halves connected to one another when a preset rotational-angle difference is exceeded. The drive system wherein the defective controller is located or wherein the interference occurs is energized by the neighboring drive system which remains intact. The rotational-angle difference does not increase beyond the preset amount, so that no collision of mechanical components is possible. Furthermore, the safety system permits the printing machine to be cranked, i.e., operated, manually, if a power failure should occur or if assembly work has to be performed on the printing machine.

The two clutch halves may be connected or coupled to one another in various ways. Thus, in accordance with another feature of the invention, the clutch is constructed as a formlocking entrainer clutch, wherein teeth of one of the clutch halves meshing with teeth of the other of the clutch halves is run onto sides of the teeth of the other clutch half when the preset rotational-angle difference is exceeded. In regard to the foregoing, it is noted that a form-locking connection is one which connects two elements together due to the shape of the elements themselves, as opposed to a forcelocking connection, which locks the elements together by force external to the elements.

In the event of a breakdown, this safety device according to the invention does not require any auxiliary energy in order to introduce a locking movement of one of the clutch halves. It is advantageous for the teeth of the clutch halves to have a trapezoidal construction. It is possible, thereby, to adjust the play or backlash of the teeth within a defined range by axially displacing at least one of the clutch halves.

The safety device according to the invention may basically be realized with any type of clutch, on condition that the clutch be actuated with respect to the torque transmission as a function of the amount of the rotational-angle difference. The rotational-angle difference may be determined by means of incremental angular encoders from which output signals are fed to a control device which, in turn, issues a signal to a device for actuating a clutch when the preset rotational-angle difference is exceeded.

With regard to maintaining an emergency operation, in accordance with a concomitant feature of the invention, means are provided for rigidly connecting the clutch halves to one another at a defined rotational-angle setting. Thus, in a relatively simple construction, a screw bolt is provided which rigidly connects the two clutch halves in a defined angular position.

Other features which are considered as characteristic for the invention are set forth in the appended claims.

Although the invention is illustrated and described herein as embodied in a safety device for controllers or regulators of drive units of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
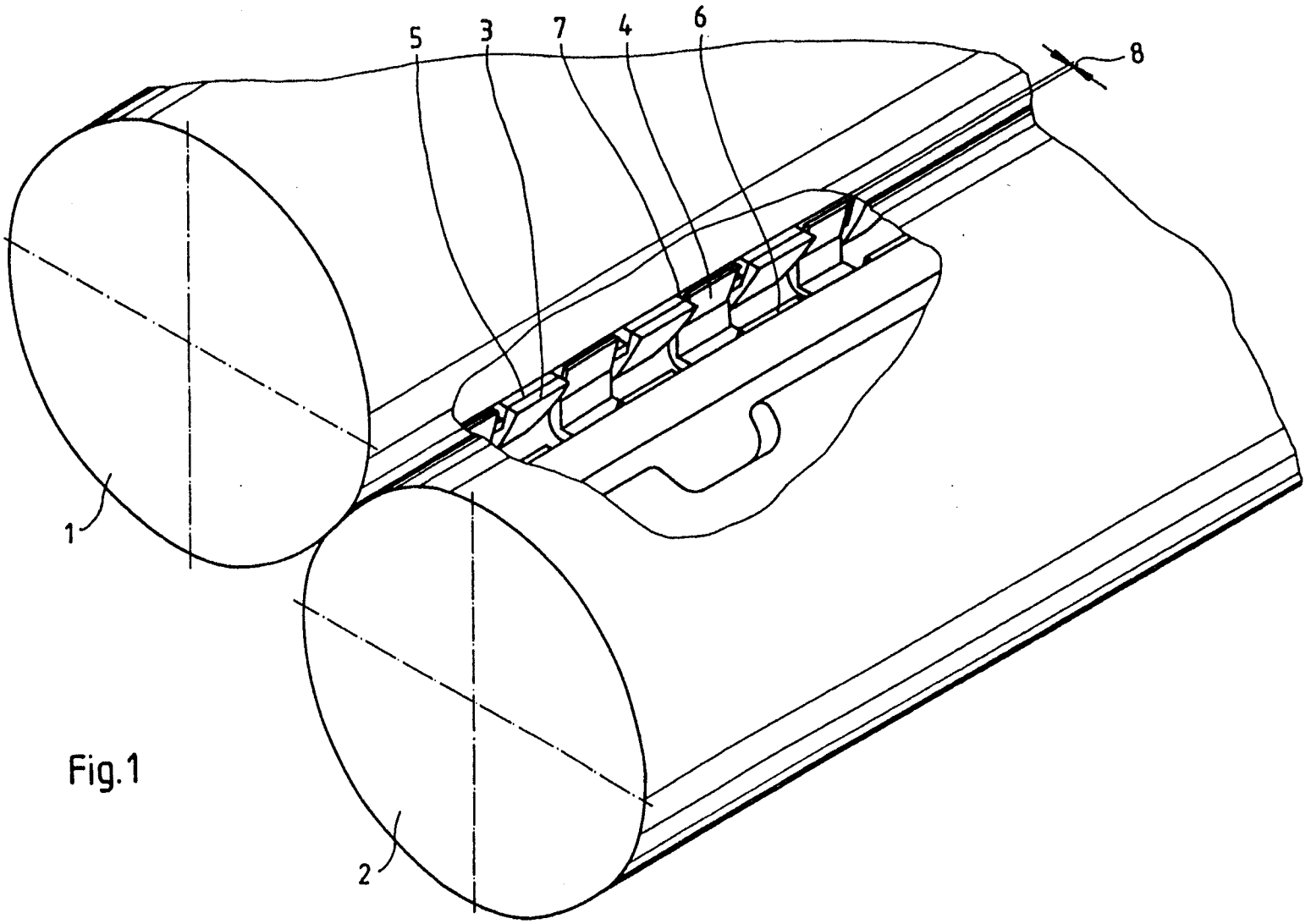
FIG. 1 is a fragmentary perspective view of cylinders and respective gripper systems of a printing machine, partly broken away to show a zone of collision therebetween.

Referring now to the drawings and, first, particularly to FIG. 1 thereof, there is shown therein two cylinders 1 and 2 having gripper systems 3 and 4, respectively, in a transfer position, the cylinders 1 and 2 being disposed in a transfer region of two otherwise non-illustrated, mechanically disconnected or decoupled printing units of a sheet-fed printing machine. During normal or standard operation, the cylinders 1 and 2 are driven in angular synchronism so that no risk of collision between a respective gripper system 3, 4 and an outer cylindrical surface of a respective cylinder 1, 2 exists. As viewed in FIG. 1, the gripper system 3 of the cylinder 1 is closed, i.e., during transport of a sheet by the cylinder 1, the respective sheet is held between gripper pads 5 and the gripper system 3. The gripper system 4 of the cylinder 2 is opened shortly before sheet transfer in order to permit the sheet to be received between gripper pads 6 and the gripper system 4.

Because the orbit or circular path described by the opened gripper system 4 is wider, i.e., has a greater diameter, than the actual cylinder 2, a recess constituting a free space 8 approximately 1 mm wide is formed between an edge of the outer cylindrical surface 7 of the cylinder 1 and the gripper system 4 of the cylinder 2. During sheet transfer, it is therefore absolutely necessary that the angular synchronism between the cylinders 1 and 2 be maintained in order to avoid damage to the gripper systems 3 and 4 and the cylinders 1 and 2, respectively.

Figure 2:
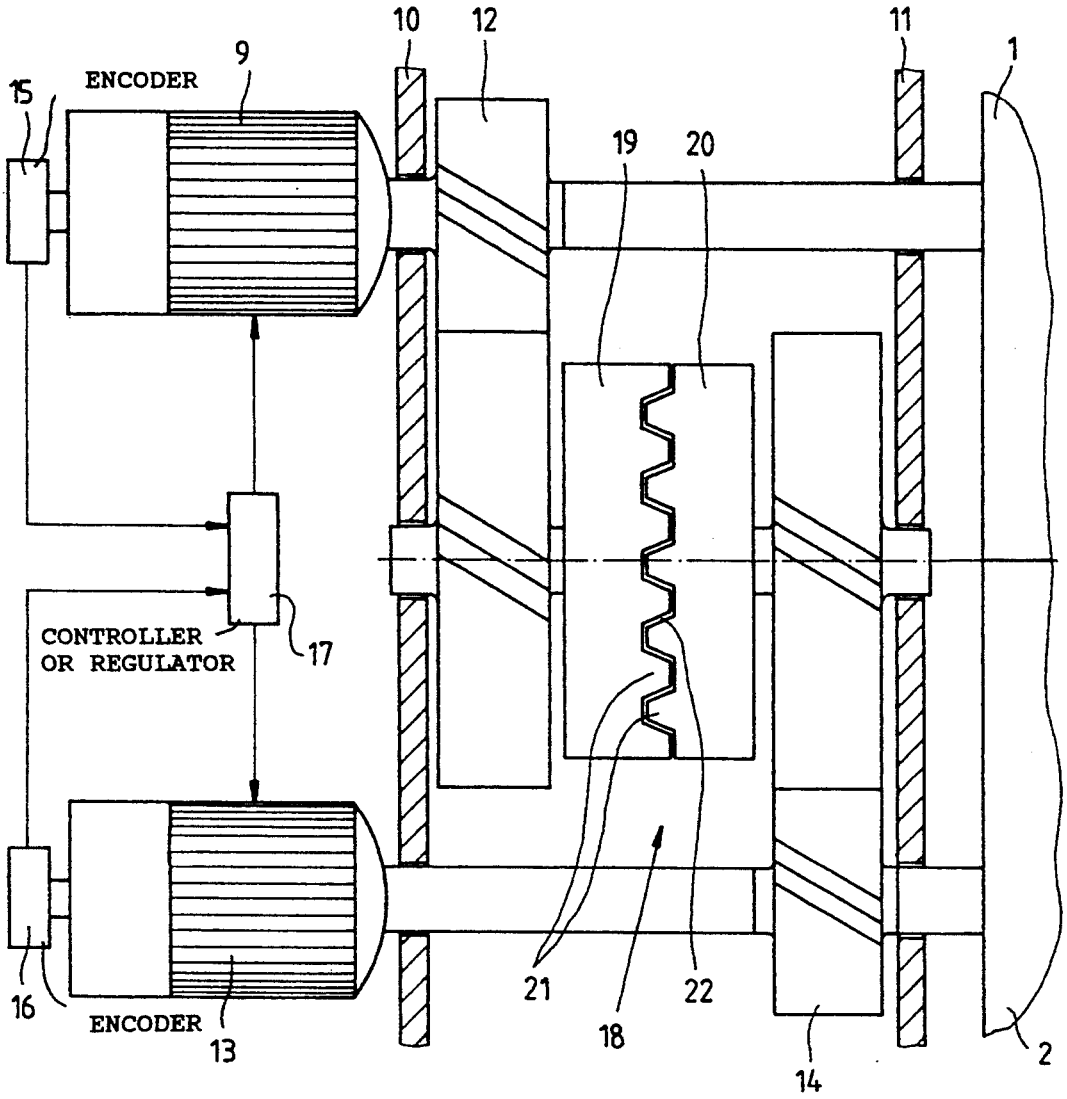
FIG. 2 is a diagrammatic and schematic elevational view of an embodiment of a safety device according to the invention, shown connected to the cylinders of FIG. 1.

FIG. 2 illustrates an embodiment of a safety device according to the invention which is provided to prevent collisions in the event of a breakdown. In FIG. 2, the cylinders 1 and 2 are components of mechanically disconnected or decoupled sub-aggregates, each of which is separately driven by a respective drive system. A first drive system is formed of a motor 9 which drives the cylinder 1 via a gear transmission 12 suitably mounted between and in side frames 10 and 11. A second drive system includes another motor 13 which drives the cylinder 2 via a gear transmission 14 which is decoupled or disconnected from the gear transmission 12. On shafts of the respective motors 9 and 13, incremental angular encoders 15 and 16, respectively, are connected to a controller 17 which has actuators or adjusting members for the power output of the motors 9 and 13 and is connected to the motors 9 and 13.

Figure 3:
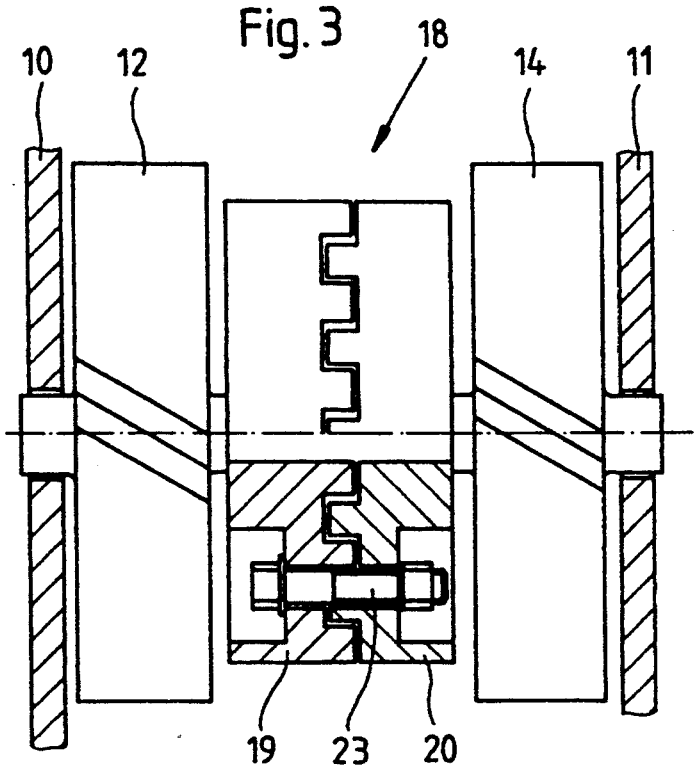
FIG. 3 is a fragmentary view of FIG. 2 showing another embodiment of the safety device which is provided with a mechanical restraining coupling or connection in emergency operation.

The core of the safety device according to the invention is a positive or entrainer clutch 18 having two clutch halves 19 and 20. Each clutch half 19, 20 is connected to the gear transmissions 12 and 14, respectively. During standard or normal operation, the clutch halves 19 and 20 rotate in synchronism, i.e., the flanks or sides of respective trapezoidal teeth 21 of the clutch halves 19 and 20 are not in contact with one another. Play or backlash 22 between the respective teeth 21 of the clutch halves 19 and 20 permits a given deviation in the rotational angle, within the range of which, control deviations may be compensated for by the controller 17. If the rotational-angle difference exceeds a given amount, the flanks or sides of the teeth 21 come into contact with one another so that the first drive system is connected to the second drive system via the positive or entrainer clutch 18. The play or backlash 22 may be adjusted by axially displacing one or both of the clutch halves 19 and 20 within a given range. In order to be able to maintain emergency operation in the event of a breakdown of one of the motors 9 and 13, the clutch halves 19 and 20 of the clutch 18 may be rigidly connected to one another via a screw connection 23, as in the embodiment of the safety device shown in FIG. 3

The foregoing is a description corresponding in substance to German Application P 42 02 722.5, dated Jan. 31, 1992, the International priority of which is being claimed for the instant application, and which is hereby made part of this application. Any material discrepancies between the foregoing specification and the aforementioned corresponding German application are to be resolved in favor of the latter.

It is claimed:

1. Safety device for control or regulation systems of drive units of a printing machine having at least two individual sub-aggregates thereof mechanically disconnected from one another, the drive units having a plurality of motors, respective gear transmissions via which the plurality of motors are connected to the sub-aggregates for driving them in synchronous rotation, at least one measuring device for ensuring synchronous running of the sub-aggregates, and a device for controlling the rotary speed or the torque of the motors connected to the measuring device, the safety device comprising a clutch disposable between the gear transmissions of the at least two individual sub-aggregates, said clutch having clutch halves respectively connectible to the respective gear transmissions, said clutch halves having a preset rotational-angle difference therebetween at which said clutch halves are disengaged, said clutch halves being engageable with one another for transmitting torque when the preset rotational-angle difference between said clutch halves is exceeded.

2. Safety device according to claim 1, wherein said clutch is constructed as a formlocking entrainer clutch and said clutch halves thereof are formed with respectively meshing teeth which, in a normal operation condition of the drive units, wherein said clutch halves are within a tolerance range of the preset rotational-angle difference, are out of engagement with one another and, in a condition wherein said clutch halves exceed said tolerance range of the preset rotational-angle difference, are in engagement with one another.

3. Safety device according to claim 2, wherein said teeth of said clutch halves have a trapezoidal construction.

4. Safety device according to claim 2, wherein at least one of said clutch halves is displaceable in axial direction thereof so as to be axially adjustable with respect to the other of said clutch halves.

5. Safety device according to claim 1, including means for rigidly connecting said clutch halves to one another at a defined rotational-angle setting.

* * * * *